United States Patent [19]

Lammert

[11] Patent Number: 5,050,400

[45] Date of Patent: Sep. 24, 1991

[54] SIMPLIFIED HOT GAS DEFROST REFRIGERATION SYSTEM

[75] Inventor: Paul F. Lammert, Danville, Ill.

[73] Assignee: Bohn, Inc., Danville, Ill.

[21] Appl. No.: 484,847

[22] Filed: Feb. 26, 1990

[51] Int. Cl.[5] ..... F25D 21/06

[52] U.S. Cl. ..... 62/278; 62/196.4; 62/509; 62/513

[58] Field of Search ..... 62/196.1, 196.4, 277, 62/278, 81, 503, 513, 509, 113, 324.5

[56] References Cited

U.S. PATENT DOCUMENTS

| | | | |
|---|---|---|---|
| 2,770,104 | 11/1956 | Sweynor | 62/117.55 |
| 3,004,399 | 10/1961 | Keller | 62/278 X |
| 3,786,651 | 1/1974 | Eschbaugh | 62/222 |
| 3,967,782 | 7/1976 | Eschbaugh | 236/92 |
| 4,083,195 | 4/1978 | Kramer et al. | 62/196 |
| 4,095,438 | 6/1978 | Kramer | 62/278 |
| 4,102,151 | 7/1978 | Kramer et al. | 62/278 |
| 4,236,381 | 12/1980 | Imral et al. | 62/503 X |
| 4,798,058 | 1/1989 | Gregory | 62/278 |

FOREIGN PATENT DOCUMENTS

| | | | |
|---|---|---|---|
| 835892 | 4/1952 | Fed. Rep. of Germany | 62/278 |

OTHER PUBLICATIONS

Bulletin 413.3—Medium Profile-Hot Gas Defrost Unit Collers—Wickes Manufacturing Company, Bohn Heat Transfer Division, 1986.

Bulletin 0 & 1413.3—Operating and Installation Instructions, Model MPG (REV.F)—Wickes Mfg. Co., Bohn Heat Transfer Div., 1986.

*Primary Examiner*—Harry B. Tanner

*Attorney, Agent, or Firm*—Allegretti & Witcoff, Ltd.

[57] ABSTRACT

A hot gas defrost refrigeration system has a compressor, a condenser, and an evaporator, interconnected by fluid passage means and incorporating valve means to cause refrigerant to flow sequentially through the compressor, condenser, and evaporator to the compressor during the refrigeration cycle. Refrigerant flow during the defrost cycle is from compressor to evaporator through the condenser to the compressor. The refrigeration system includes defrost passage means, including valve means, connecting the evaporator outlet to the condenser inlet and connecting the condenser outlet to the compressor inlet. A vessel is provided which combines the functions of receiver during refrigeration and superheater during defrost. During refrigeration liquid refrigerant flows from the condenser through the superheater/receiver to the evaporator. During defrost, the defrost passage means directs vaporous refrigerant from the evaporator through the superheater/receiver to the compressor. The compressor discharge passage to the evaporator includes a superheat passage in heat exchange relationship with the superheater for transferring heat from compressor discharge refrigerant to compressor suction refrigerant during the defrost cycle. The condenser is utilized as a reevaporator during defrost and the superheater/receiver exchanges heat between compressor inlet and suction refrigerant to enhance system operation during the defrost cycle.

8 Claims, 4 Drawing Sheets

SIMPLIFIED HOT GAS DEFROST REFRIGERATION SYSTEM

FIELD OF THE INVENTION

This invention relates generally to refrigeration systems and, more specifically, to commercial refrigeration systems using a hot gas defrost cycle to defrost a frosted evaporator.

BACKGROUND OF THE INVENTION

A common method of defrosting a commercial refrigeration system frosted evaporator is to halt the refrigeration cycle and activate electric heaters in the evaporator. This method is time consuming and often leads to temperature cycling of the refrigerated space. This cycling can drastically affect the life of the product, frequently foodstuff, being cooled in the refrigerated space.

There are many commercial refrigeration systems which utilize a hot gas defrost cycle that have been in use for many years. In one such arrangement, the refrigeration cycle is merely reversed to cause hot vaporous refrigerant from the compressor to cycle in reverse into the evaporator outlet, through the evaporator, out its inlet to the condenser outlet, through the condenser, out its inlet and back to the compressor.

Another method of hot gas defrost is illustrated in U.S. Pat. No. 2,770,104—Sweynor, which describes an older system. That system merely bypassed the condenser in the defrost cycle, an arrangement found to be unsuitable for two reasons. Since the temperature of refrigerant in the compressor suction line was too low, it produced some liquid which entered the compressor, ultimately causing compressor damage. Also, the temperature of the vaporous refrigerant delivered to the evaporator during the defrost cycle was found to be too cool to effect rapid defrosting.

The Sweynor improvement added a means of superheating the refrigerant discharged by the compressor and delivered to the evaporator. This heat was provided by electrically heating a tank filled with water through which the compressor discharge line was routed. Since heat was added to the defrosting cycle, this also raised the temperature of the suction refrigerant. This arrangement added an expensive heater, electricity cost, and heater maintenance cost. It also had the unfortunate result of so heating the evaporator inlet refrigerant temperature that a commercial system having many feet of evaporator inlet tubing would experience sufficient tubing growth to distort and break tubing.

More recently, a system which effects evaporator defrosting in a different manner has met with some commercial success. This is disclosed in U.S. Pat No. 4,102,151—Kramer et al. This patent relates a hot gas defrost system in which vaporous refrigerant discharged from the compressor during the defrost cycle is routed through a tank filled with water, thus transferring heat to the water and desuperheating the refrigerant delivered to the evaporator. The evaporator discharge line is then routed through this water tank only during the defrost cycle to theoretically superheat the compressor suction refrigerant sufficiently to assure complete vaporization.

However, in practice the assignee of the Kramer patent has found that auxiliary heat is needed for the water tank (located outside) to prevent freezing in the winter. This arrangement thus suffers from several of the drawbacks found with the arrangement disclosed in the above Sweynor patent.

Recently, this inventor has invented a hot gas defrost refrigeration system which is simple, inexpensive and does not rely on external sources of heat for operation. This refrigeration system has a compressor, a condenser, an evaporator, each having inlets and outlets interconnected by fluid passage means. This system incorporates valve means to cause refrigerant to flow sequentially through the compressor, the condenser, the evaporator and back to the compressor during the refrigeration cycle, and to flow sequentially through the compressor, the evaporator, via defrost passage means, through the condenser and back to the compressor during the defrost cycle, thereby utilizing the condenser as a reevaporator during the defrost cycle.

It further includes a superheater in the defrost passage means which receives refrigerant from the condenser outlet during the defrost cycle and delivers it to the compressor inlet. The passage means connecting the compressor outlet with the evaporator inlet includes a superheat passage in heat exchange relationship with the superheater for transferring heat from the refrigerant discharged from the compressor outlet to the refrigerant delivered to the compressor inlet to enhance operation of the system during the defrost cycle.

This system normally incorporates a receiver for receiving condenser discharge refrigerant during the refrigeration cycle. A valve is included to direct the flow of the evaporator discharge refrigerant to the receiver or to the superheater during the appropriate cycle.

It is desirable to further simplify this refrigeration system.

SUMMARY OF THE INVENTION

It is therefore an object of this invention to simplify a refrigeration system which accomplishes defrosting of a frosting evaporator without use of outside sources of heat. This is accomplished by combining the receiver and superheater into a single device.

In accordance therewith, this invention provides a combined superheater/receiver for use in a hot gas defrost refrigeration system which has a compressor, an evaporator, a condenser, interconnecting fluid passages and valve means to cause refrigerant to flow sequentially from the compressor to the condenser to the evaporator and back to the compressor during the refrigeration cycle, and sequentially from the compressor to the evaporator and, via defrost passage means, to the condenser and back to compressor during the defrost cycle.

This combined superheater/receiver is located in the defrost passage means and comprises an elongated vessel having an inlet for receiving refrigerant from the condenser during both cycles, a first outlet for delivering liquid refrigerant to the evaporator during the refrigeration cycle, a second outlet for delivering vaporous refrigerant to the compressor during the defrost cycle, and a closed fluid conduit in heat exchange relationship therewith connected to the compressor discharge for exchanging heat from the compressor discharge refrigerant in the fluid conduit to the compressor suction refrigerant in the vessel during the defrost cycle.

Preferably, the first conduit extends from an opening exteriorly of the vessel to an opening at the bottom of the vessel, to assure that liquid refrigerant is delivered to the evaporator during the refrigeration cycle, and the second conduit extends from an opening exteriorly of the vessel to an opening at the top of the vessel to assure that vaporous refrigerant is delivered to the compressor during the defrost cycle.

Also, the closed fluid conduit extends through the interior of the vessel between an inlet and an outlet opening exteriorly of the vessel to enable optimal heat transfer between the fluid in the passage and the fluid in the vessel without any mixing thereof.

Thus, this invention further simplifies an improved hot gas defrost refrigeration system by combining the functions of a receiver and a superheater into a single vessel.

These and further features and advantages of this invention will become more readily apparent upon reference to the following detailed description of the invention, as illustrated in the accompanying drawings, in which:

DETAILED DESCRIPTION OF THE INVENTION

Figures 1, 2:
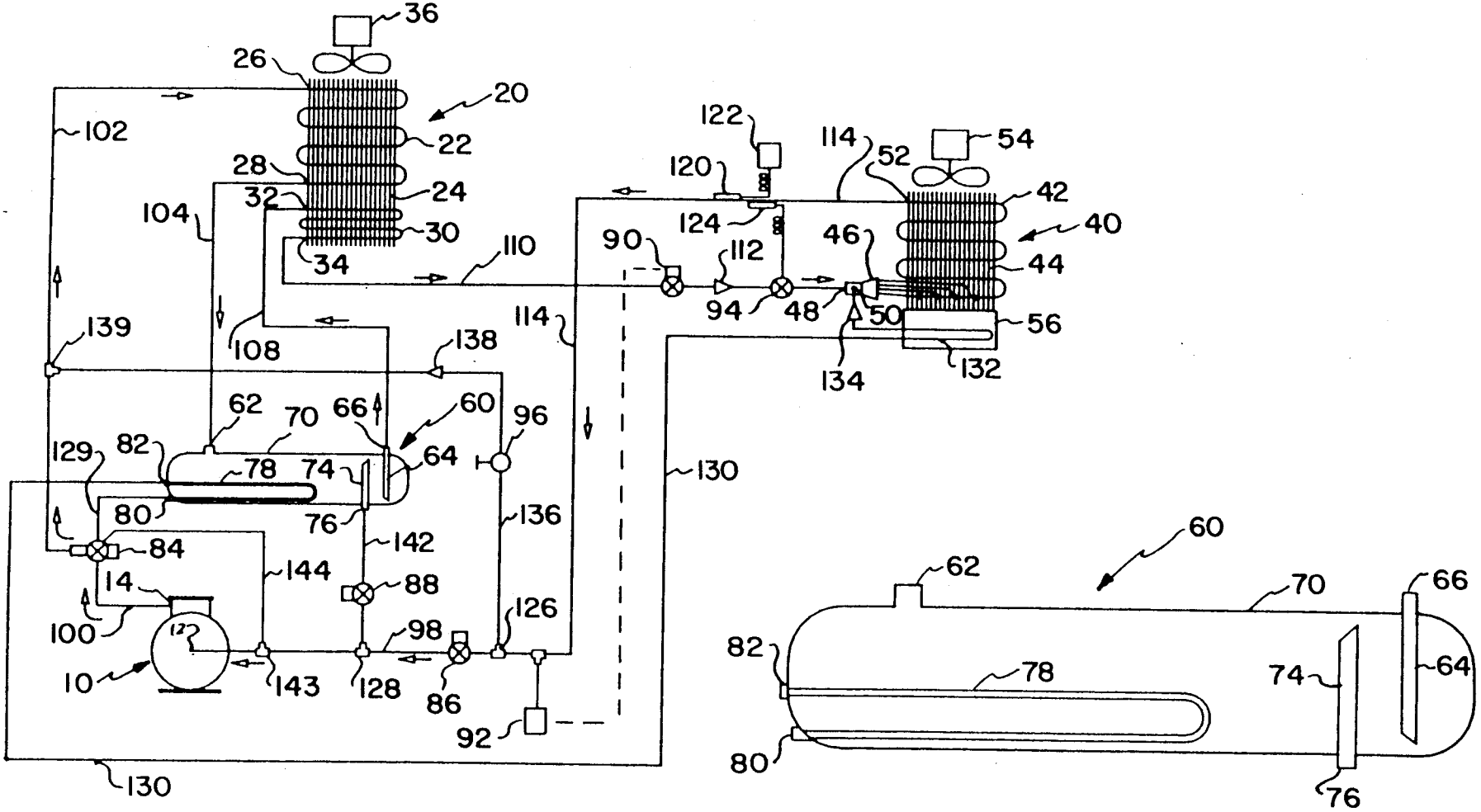
FIG. 1 is a schematic diagram of one embodiment of a refrigeration system according to this invention, illustrating system operation during the refrigeration cycle.
FIG. 2 is a schematic sectional side view of a combined superheater/receiver according to this invention.

FIG. 1 depicts a hot gas defrost refrigeration system, according to this invention, which includes a refrigerant compressor 10 of any conventional type. A suction port 12 and a discharge port 14 are provided for transferring refrigerant through compressor 10 where it is compressed and thus heated.

A refrigerant condenser 20 is provided with tubing coils 22 which undulate through a spaced stack of heat exchange fins or plates. Condenser 20 includes an inlet 26 and an outlet 28 for translating refrigerant through coils 22. A subcooling loop of coils 30, having inlet 32 and outlet 34 similarly snakes through fins 24. Condenser 20 is conventionally placed exteriorly of a building which contains a space, or room, to be refrigerated (not shown). An electric fan 36 is supplied to blow ambient air through fins 24 to exchange heat between refrigerant flowing through coils 22 and 30 and the air.

A refrigerant evaporator 40 is provided for cooling the refrigerated space, and includes tubing coils 42 which undulate through a spaced stack of heat exchange fins 44. A side-ported distributor 46 is supplied with liquid refrigerant through a refrigeration cycle inlet 48, or with hot vaporous refrigerant through a defrost cycle inlet 50, as will be later described. Refrigerant exits the coils 42 of evaporator 40 through an outlet 52. An electric fan 54 may be selectively activated to blow air in the refrigerated space through fins 44 to exchange heat from the air to the refrigerant flowing through coils 42 during the refrigerating cycle, as later described. A drain pan 56 sits beneath evaporator 40 to collect water which drips off coils 42 as they are defrosted, as later detailed.

Referring also to FIG. 2, the refrigeration system further includes a combined refrigerant superheater/-receiver 60 comprises an elongated refrigerant tank 70 having an inlet 62. Tank 70 also mounts a dip tube 64 connected to a refrigeration cycle outlet 66 which is used when functioning as a refrigerant receiver during the refrigeration cycle. In accordance with this invention, the superheater/ receiver 60 also functions as a superheater during the defrost cycle. As such, it includes a standpipe 74 connected to a defrost cycle outlet 76, and a closed superheat conduit 78 having an inlet 80 and an outlet 82.

Refrigerant is transferred among compressor 10, condenser 20, evaporator 40 and superheater/receiver 60 by fluid passage and control means which include several valves that will now be described. Distribution of compressed refrigerant vapor discharged from compressor 10 is controlled by a compressor discharge valve 84, while compressor suction valve 86 is provided to control the source of refrigerant vapor inflow to the compressor.

Distribution of refrigerant discharged from superheater/receiver 60 is controlled by a superheater control valve 88. The source of supply of refrigerant to evaporator 40 is regulated by an evaporator supply valve 90. Operation of valve 90 is controlled by a compressor suction pressure sensor 92. A refrigeration cycle expansion valve 94 is provided to supply refrigerant to evaporator distributor 46 during the refrigeration cycle. Valve 94 is preferrably a "Bohnmizer" valve commercially available from inventor's assignee. This valve is disclosed in U.S. Pat. Nos. 3,786,651 and 3,967,782 to Eschbaugh et al. A pressure regulating valve 96 regulates the flow of refrigerant to the condenser during the defrost cycle.

The fluid passage means for transferring refrigerant as directed by the above valves will now be described. Compressed vaporous refrigerant is discharged from compressor 10 through a conduit 100 into discharge valve 84. Valve 84 has several outlet ports, one of which connects to a condenser supply conduit 102 which is connected to condenser inlet 26. Condenser outlet 28 connects to a discharge conduit 104 that is attached at its other end to superheater/receiver inlet 62. A conduit 108 connects superheater/receiver outlet 66 with subcool loop inlet 32, while subcool loop outlet 34 connects to one end of the evaporator refrigerant cycle supply conduit 110. The other end of conduit 110 attaches to refrigeration inlet 48 of distributor 46. Conduit 110 incorporates evaporator supply valve 90, a check valve 112 and the refrigeration cycle expansion valve 94.

Refrigerant is discharged from evaporator outlet 52 into a conduit 114 and has its temperature monitored by a temperature sensor 120 of the system defrost cycle controller 122, and by temperature sensor 124 of expansion valve 94. Pressure in conduit 114 is monitored by pressure controller 92 of evaporator supply valve 90. Conduit 114 incorporates a tee 126 and terminates at compressor suction valve 86. The compressor suction conduit 98 conveys vaporous refrigerant from valve 86 to compressor 10.

The other outlet port of compressor discharge valve 84 connects to a conduit 129 which conveys refrigerant through superheat loop 78 and conduit 130 to the evaporator 40. Conduit 130 includes a loop 132, that is in heat exchange relationship with evaporator drain pan 56, and connects through a check valve 134 to the side port 50 of refrigerant distributor 46. A defrost bypass conduit 136 is connected to tee 126 and extends through a self-modulating pressure control valve 96 that has a manually-adjustable orifice. Conduit 136 extends through a check valve 138 to a tee 139 in conduit 102.

Fluid drawn out of superheater/receiver 60 through standpipe 74 exits outlet 76 into conduit 142 and flows through valve 88 and tee 128 into suction conduit 98, past a tee 143 and into suction port 12. Valve 84 has a bleed port which functions to bleed conduit 130 through a bleed line 144 and tee 143 to suction conduit 98 when valve 84 is connected to conduit 102.

Operation of the system during the refrigeration cycle will now be described with reference to FIG. 1 which includes directional arrows to indicate the direction of refrigerant flow through the system. At the initiation of the refrigeration cycle, solenoid valve 88 is closed, and solenoid valves 86 and 90 are opened. Valve 84 is shifted to outlet to conduit 102.

Refrigerant supplied to compressor 10 from conduit 98 is compressed and discharged through conduit 100 to valve 84 and through conduit 102 to condenser 20, where it is condensed during its journey through coils 22 by the cooling ambient air blown over fins 24 by fan 36. Refrigerant is prevented from entering conduit 136 and short-circuiting to compressor suction conduit 98 by check valve 138. This condensed refrigerant is discharged from condenser 20 through conduit 104 to superheater/receiver 60, which now acts as a receiver. During the refrigeration cycle, valve 88 is closed so that no refrigerant can flow out of tank 70 through conduit 142. Also, standpipe 74 is tall enough so that the level of liquid refrigerant in tank 70 will not reach its entrance Refrigerant is withdrawn from superheater/receiver 60 through dip tube 64 and flows through subcooling loop 30 where it is further cooled to assure that only liquid refrigerant is delivered to evaporator 40. Refrigerant flows through conduit 110, through valve 90, which is usually conventionally opened and closed in response to refrigeration requirements in the refrigerated space during this cycle, although it may be selectively closed as later described. Flow continues through check valve 112, expansion valve 94 and distributor 46 into coil 42. Refrigerant flow through distributor side port 50 into heating loop 132 is prevented by check valve 134.

Refrigerant vaporizes in coil 42 and absorbs heat from the ambient air in the refrigerated space which is blown over fins 44 by fan 54. Vaporous refrigerant is discharged from evaporator 40 into conduit 114. Temperature sensor 124 monitors refrigerant temperature in conduit 114 and modulates refrigerant flow through expansion valve 94, thereby controlling the superheat temperature of refrigerant discharged into conduit 114. Refrigerant flow into conduit 114, and into suction conduit 98, from conduit 102 through conduit 136 (a short circuit) is prevented by check valve 138. Since solenoid valve 86 is open during the refrigeration cycle, vaporous refrigerant flows through it. Refrigerant then flows through suction port 12 into compressor 10 to begin a new refrigerating cycle.

During refrigeration operation, evaporator 40 will gradually frost over, thus severely reducing heat transfer from ambient air to refrigerant. Periodically, the system controller will command that the refrigeration cycle be halted and a defrost cycle be initiated. This operation will now be described with reference to FIG. 4, which includes directional arrows to indicate the direction of refrigerant flow during this cycle. At this time, solenoid valves 86 and 90 are closed, and solenoid valve 88 is opened. Valve 84 is shifted to outlet to conduit 130 and evaporator fan 54 is turned off.

Closing of valve 86 suddenly changes the source of refrigerant for compressor suction. Any liquid refrigerant in condenser 20 and in conduit 110 will flow into superheater/receiver 60 where it will join the liquid refrigerant already there. All this liquid refrigerant will be rapidly vaporized by compressor suction, since it can enter standpipe 74 only as a vapor. Vaporous refrigerant will enter compressor suction conduit from superheater/receiver 60 and conduit 142. Hot vaporous refrigerant is discharged from compressor 10 through conduit 100 into valve 84 and through conduit 129 into superheat loop 78 and into conduit 130. This refrigerant is delivered to drain pan heating loop 132, through side port 50 of distributor 46 and into evaporator coil 42. As the hot vaporous refrigerant courses through coil 42, it begins melting the frost which has collected on the coils 42 and fins 44 during refrigeration. Upon melting, the water drips into pan 56 and is drained outside the refrigerated space. Heat supplied to pan 56 by the hot vaporous refrigerant in drain heating loop 132 prevents freezing of water in the pan.

As the vaporous refrigerant traverses coil 42, it is cooled and condensed, emerging from outlet 52 as a liquid which flows into conduit 114. Since solenoid valve 86 is closed, refrigerant enters defrost bypass conduit 136, where the pressure regulating valve 96 functions as a defrost cycle expansion valve. This valve is a self-modulating valve having a manually adjustable orifice. Refrigerant flows through check valve 138 and into evaporator supply conduit 102. Since the outlet from valve 84 to conduit 102 is closed, refrigerant flows into condenser 20.

Unlike commercially available hot gas defrost refrigeration systems, this invention uses the condenser as a reevaporator during the defrost cycle. Heat transfers to the refrigerant flowing through coils 22 from the ambient air blown over fins 24 by fan 36 and the refrigerant is vaporized as it traverses coil 22. It exits outlet 32 into conduit 104 as vaporous refrigerant and flows into superheater/receiver 60, which now acts as a superheater. The cool vaporous refrigerant in tank 70 is superheated by the hot vaporous refrigerant discharged from compressor 10 through superheat conduit 78. Conversely, refrigerant in conduit 78 is desuperheated by the heat transfer to refrigerant in tank 70. The superheated vaporous refrigerant exits superheater/receiver 60 through standpipe 74 into conduit 142 and past now-open valve 88 into compressor suction conduit 98 and thence into compressor 10 for another cycle through the system. Vaporous refrigerant will not enter tank 70 through dip tube 64 into conduit 108 because of check valve 112.

This invention utilizes a superheater to enhance operation during the defrost cycle, a recent invention of this inventor. A feature of this invention is combining functions of the superheater and of a conventional refrigerant receiver into a single vessel. This is a cost saving by eliminating one vessel and requiring less conduit for the refrigeration system.

The defrost cycle is terminated in one of two ways. When thermostat 122 senses a predetermined temperature high enough to assure that all frost has melted from evaporator coil 42, it will signal the system controller to terminate the defrost cycle and initiate the refrigeration cycle. This function could also be performed by a pressurestat in conduit 114 which could make the same determination. Alternatively, a time-out feature could be utilized to terminate after a predetermined time.

A return to the refrigeration cycle causes valves 86 and 90 to open, valve 88 to close, and valve 84 to outlet to conduit 102, while closing conduit 130. At the end of the defrost cycle, pressure in conduit 114 is high because of the functioning of pressure regulator 96. The sudden opening of valve 86 exposes the compressor to a high suction pressure which could overload it. This pressure condition is sensed by pressure controller 92 which acts to delay opening of solenoid valve 90 until suction pressure has been reduced to an acceptable level. Bleed conduit 144 is connected to an internal bleed port in valve 84 and functions to draw refrigerant which is in conduit 130 at termination of the defrost cycle back into the system. This utilizes all refrigerant during both cycles and minimizes the refrigerant charge required to operate the system.

Thereafter, the system operates as described above to refrigerate the refrigerated space during the refrigeration cycle.

Figure 3:
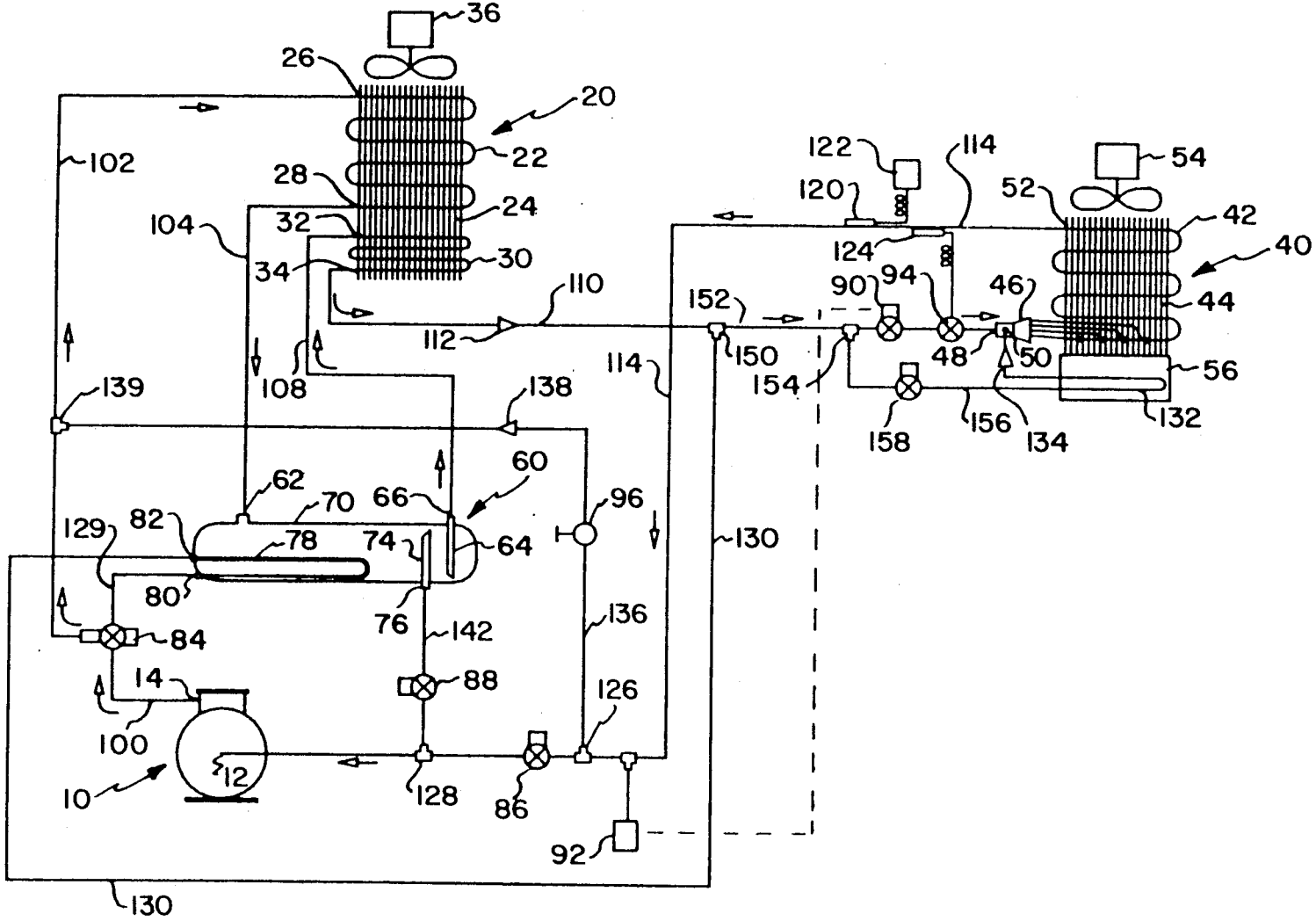
FIG. 3 is a schematic diagram of another embodiment of a refrigeration system according to this invention, illustrating system operation during the refrigeration cycle.
Figure 4:
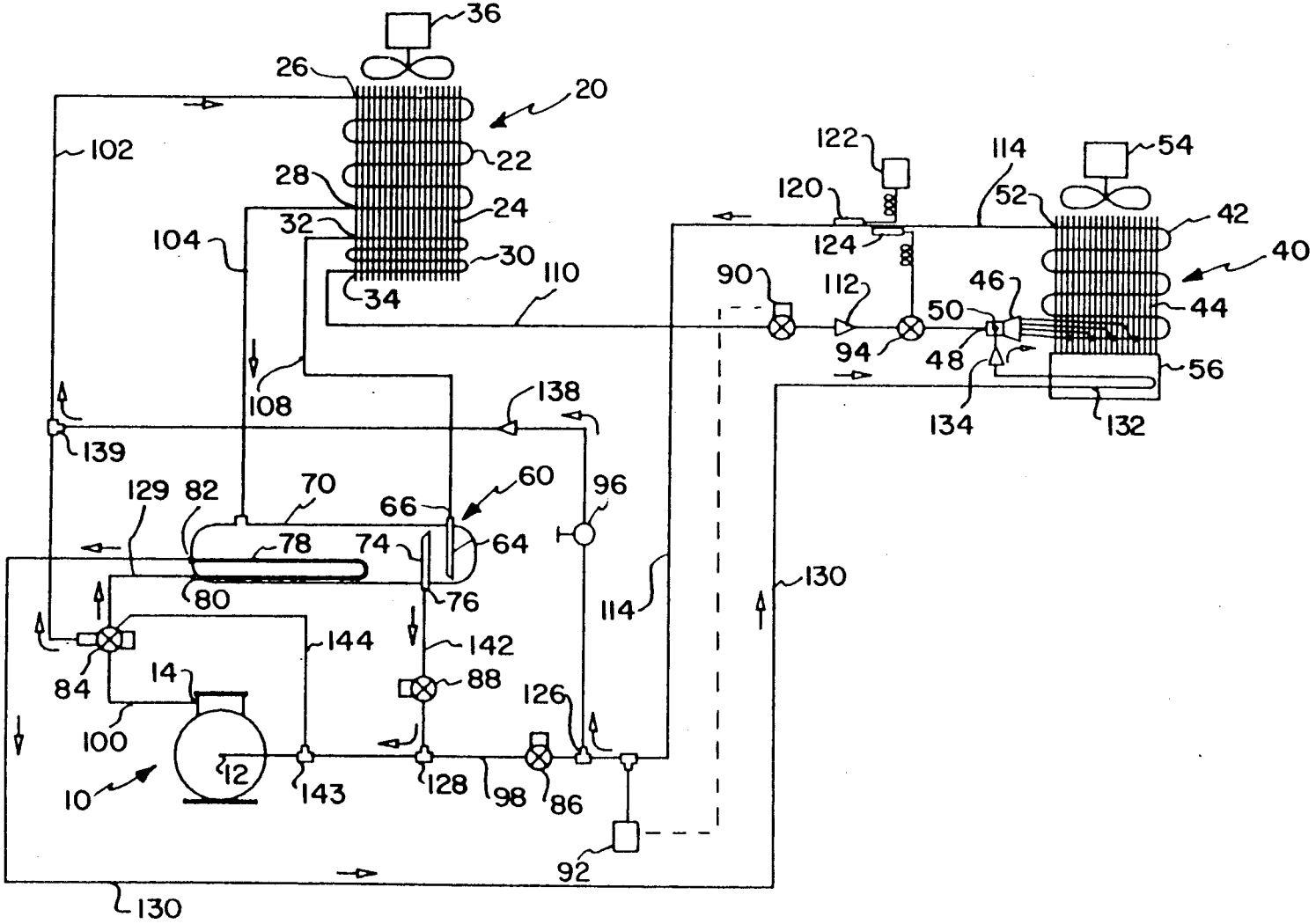
FIG. 4 is another schematic diagram of the FIG. 1 embodiment, illustrating system operation during the defrost cycle.
Figure 5:
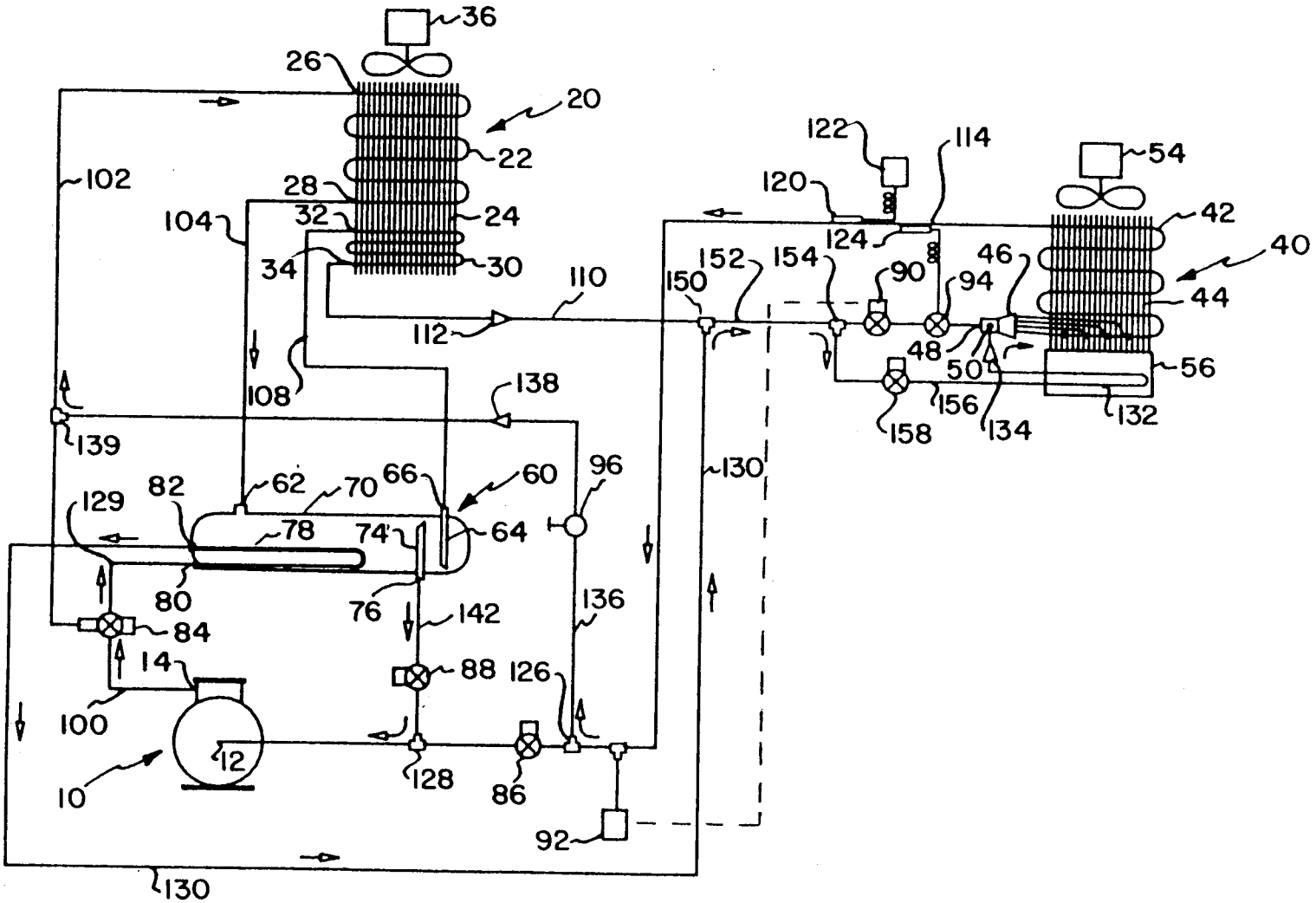
FIG. 5 is another schematic diagram of the FIG. 3 embodiment, illustrating system operation during the defrost cycle.

FIGS. 3 and 5 illustrate another embodiment of this invention, which incorporates only a slight modification of the FIGS. 1 and 4 embodiment just described. Like elements in the FIGS. 3 and 5 embodiment are identically numbered. The modifications relate to the means of supplying compressor discharge refrigerant to the evaporator during the defrost cycle. FIG. 3 depicts refrigerant flow during the refrigeration cycle, while FIG. 5 depicts operation during the defrost cycle.

As shown in FIGS. 3 and 5, the defrost cycle evaporator supply conduit 130 is connected into the refrigeration cycle evaporator supply conduit 110 at a tee !50. The supply conduit downstream of tee 150 is denoted 152 and serves to supply the evaporator 40 during both cycles. The purpose of providing this dual-purpose supply conduit is cost saving, since it is this reach of conduit that may stretch considerable distances in practical application. It is a cost saving to eliminate this long segment of conduit 130 from the FIG. 1 embodiment.

A tee 154 is provided in conduit 152 to connect a bypass conduit 156 to drain pan heating loop 132 through a solenoid valve 158. Check valve 112 is relocated to a position in conduit 110 upstream of tee 150 to prevent backflow into subcool loop 30 and receiver 60 during the defrost cycle. Shutoff valve 90 is located downstream of tee 154 and functions as before. In this embodiment, the internal bleed port is eliminated from compressor discharge control valve 84, and tee 143 and bleed conduit 144 are also eliminated. Operation of this modified system is little changed from that described above in reference to FIGS. 1 and 4.

During the refrigeration cycle, valve 90 is still open and valve 158 is closed. Liquid refrigerant discharged from subcooling loop 30 flows through check valve 112, conduit 152, valve 90, and expansion valve 94 into distributor 46. Flow into conduit 130 is prevented, since the valve 84 outlet to conduit 130 is closed and bleed conduit 144 was eliminated. Flow into bypass conduit 156 is blocked by closed valve 158.

During the defrost cycle, valve 90 is closed and valve 158 is opened. Hot vaporous refrigerant flows from compressor 10 through conduit 130 to conduit 152. Backflow into subcool loop 30 and receiver 60 is prevented by check valve 112. Closure of valve 90 forces refrigerant to flow through conduit 156 and open valve 158 into distributor side port 50. Any liquid in conduit 152 is forced through evaporator. Since it bypasses expansion valve 94, this warm liquid contributes to the defrosting of coil 42.

Thus, both embodiments of the invention described above provide a refrigeration system which provides a hot gas defrost cycle that employs the condenser as a reevaporator and utilizes heat exchange between compressor discharge and suction refrigerant to enhance defrosting action and system efficiency. The system is simplified by combining the functions of both the receiver and the superheater into a single vessel.

I claim:

1. A refrigeration system having refrigeration and defrost cycles comprising:

a compressor having suction and discharge ports, a condenser having an inlet and an outlet, a refrigerating evaporator subject to frosting and having an inlet, including inlet valve means, and an outlet, compressor discharge passage means including compressor discharge valve means connected to the compressor discharge port, a first conduit connecting said valve means with the condenser inlet, and a second conduit connecting said valve means with the evaporator inlet valve means, said valve means being operable to direct compressor discharge refrigerant to the first conduit during the refrigeration cycle, and to the second conduit during the defrost cycle, condenser outlet passage means for directing refrigerant from the condenser outlet to the evaporator inlet valve means during the refrigeration cycle, evaporator outlet passage means for directing refrigerant from the evaporator outlet to the compressor during the refrigeration and defrost cycles, defrost passage means for directing refrigerant from the evaporator outlet to the condenser inlet and from the condenser outlet to the compressor during the defrost cycle, and compressor suction valve means in the evaporator outlet passage means for blocking refrigerant flow directly to the compressor from the evaporator and directing refrigerant flow through the defrost passage means during the defrost cycle, characterized by a refrigerant superheater/receiver located in the condenser discharge passage means for receiving refrigerant from the condenser, a receiver outlet conduit connecting the superheater/receiver to said evaporator inlet valve means which are operable to direct refrigerant to the evaporator during the refrigeration cycle, the defrost passage means including a superheater outlet conduit connecting the superheater/receiver to the compressor suction valve means which are operable to direct refrigerant to the compressor during the defrost cycle, and the second conduit including a superheat portion in heat exchange relationship with the superheater/receiver, thus enabling heat transfer from the compressor discharge refrigerant to the compressor suction refrigerant during the defrost cycle to superheat the compressor suction refrigerant, to assure that it is vaporous, and desuperheat the vaporous refrigerant delivered to the evaporator, thus enhancing operation of the system during the defrost cycle.

2. The refrigeration system of claim 1, further characterized by the defrost passage means including a bypass conduit connecting the evaporator outlet with the condenser inlet, and by the compressor inlet valve means including a one-way valve for permitting refrigerant flow from the evaporator outlet to the condenser inlet during the defrost cycle, but preventing reverse flow during the refrigeration cycle.

3. The refrigeration system of claim 2, further characterized by the condenser discharge passage means including an evaporator supply conduit connected to the evaporator inlet, and a second one-way valve connecting the condenser outlet to said conduit for enabling refrigerant flow from the condenser outlet to the evaporator inlet, while preventing reverse flow, the second conduit of the compressor discharge passage means connecting the compressor discharge valve means with the evaporator supply conduit to utilize the evaporator supply conduit to convey refrigerant from the condenser to the evaporator during the refrigeration cycle, and to convey refrigerant from the compressor to the evaporator during the defrost cycle.

4. The refrigeration system of claim 1, further characterized by the condenser discharge passage means including an evaporator supply conduit connected to the evaporator inlet valve means for directing refrigerant from the condenser to the evaporator, the second conduit of the compressor discharge passage means connecting the compressor discharge valve means with the evaporator inlet valve means to convey refrigerant from the compressor to the evaporator during the defrost cycle, said valve means enabling refrigerant flow from the condenser outlet to the evaporator inlet only during the refrigeration cycle, while preventing reverse flow during the defrost cycle.

5. The refrigeration system of claim 4, further characterized by the defrost passage means including a bypass conduit connecting the evaporator outlet with the condenser inlet, and by the compressor inlet valve means including a one-way valve for permitting refrigerant flow from the evaporator outlet to the condenser inlet during the defrost cycle, but preventing reverse flow during the refrigeration cycle.

6. The combined superheater/receiver of claim 1, wherein the closed fluid conduit extends through the interior of the vessel between an inlet and an outlet opening exteriorly of the vessel to enable heat transfer between the fluid in the closed fluid conduit and the fluid in the vessel without any mixing thereof.

7. A hot gas defrost refrigeration system having a compressor, a condenser, an evaporator, each having inlets and outlets interconnected by fluid passage means and incorporating valve means to cause refrigerant to flow sequentially through the compressor, condenser and evaporator to the compressor during the refrigeration cycle, and to flow sequentially through the compressor, evaporator and condenser to the compressor during the defrost cycle, characterized by a superheater/receiver adapted to receive refrigerant from the condenser outlet for discharge to the evaporator inlet during the refrigertion cycle and to the compressor inlet during the defrost cycle, the superheater/receiver being a vessel having an inlet, a first outlet connected to the evaporator inlet and a second outlet connected to the compressor inlet, the superheater/receiver having a superheat passage in heat exchange relationship therewith for conveying refrigerant discharged from the compressor to the evaporator inlet during the defrost cycle, the superheat passage being a closed fluid passage traversing the interior of the vessel and having an external inlet and outlet to enable heat to be transferred from the higher-temperature refrigerant traversing the superheat passage to the lower-temperature refrigerant flowing through the vessel to the second outlet, to assure complete vaporization thereof, and to reduce the temperature of refrigerant delivered to the evaporator during the defrost cycle thereby desuperheating the refrigerant delivered to the evaporator and superheating refrigerant delivered to the compressor inlet to enhance operation of the system during the defrost cycle.

8. A combined superheater/receiver for use in a hot gas defrost refrigeration system having a compressor, an evaporator, a condenser, interconnecting fluid passages, and valve means to cause refrigerant to flow sequentially from compressor to condenser to superheater/receiver to evaporator to compressor during the refrigeration cycle, and sequentially from compressor to evaporator to condenser to superheater/receiver to compressor during the defrost cycle, comprising an elongated vessel having an inlet for receiving refrigerant from the condenser during both cycles, a first outlet for delivering liquid refirgerant to the evaporator during the refrigerant cycle, a second outlet for delivering vaporous refrigerant to the compressor during the defrost cycle, and a closed fluid conduit in heat exchange relationship therewith connected to the compressor discharge for exchanging heat from refrigerant in the fluid conduit to the refrigerant in the vessel during the defrost cycle, said first conduit extending from an opening exteriorly of the vessel to an opening at the bottom of the vessel, to assure that liquid refrigerant is delivered to the evaporator during the refrigeration cycle, and the second conduit extending from an opening exteriorly of the vessel to an opening at the top of the vessel to assure that vaporous refrigerant is delivered to the compressor during the defrost cycle, thereby desuperheating the refrigerant delivered to the evaporator and superheating the refrigerant delivered to the compressor to enhance operation of the refrigeration system during the defrost cycle.

* * * * *

UNITED STATES PATENT AND TRADEMARK OFFICE

CERTIFICATE OF CORRECTION

PATENT NO. : 5,050,400

DATED : Sep. 24, 1991

INVENTOR(S) : Paul F. Lammert

It is certified that error appears in the above-indentified patent and that said Letters Patent is hereby corrected as shown below:

On the title page, item [73], change "Bohn, Inc." to --Heatcraft, Inc.--

Signed and Sealed this

Tenth Day of May, 1994

*Attest:*

Bruce Lehman

BRUCE LEHMAN

*Attesting Officer*

*Commissioner of Patents and Trademarks*